US005106031A

United States Patent [19]

Sanda et al.

[11] Patent Number: 5,106,031

[45] Date of Patent: Apr. 21, 1992

[54] REEL FOR WINDING METALLIC WIRE

[75] Inventors: Kenji Sanda, Ono; Hisamune Miyawaki, Miki, both of Japan

[73] Assignee: Tokusen Kogyo Company Limited, Ono, Japan

[21] Appl. No.: 675,521

[22] Filed: Mar. 26, 1991

[51] Int. Cl.[5] ..... B65H 75/14; B65H 75/18

[52] U.S. Cl. ..... 242/118.4; 242/77.3; 242/117; 242/118.6; 242/118.8

[58] Field of Search ..... 242/118.4, 118.6, 118.7, 242/118.8, 77.3, 77.4, 77, 117, 71.8

[56] References Cited

U.S. PATENT DOCUMENTS

| | | | |
|---|---|---|---|
| 785,386 | 3/1905 | Thornley | 242/77.4 |
| 1,598,912 | 9/1926 | Hoopes | 242/118.8 |
| 2,043,197 | 6/1936 | Foukal | 242/77.4 |
| 2,144,723 | 1/1939 | Howsam | 242/118.8 |
| 2,150,392 | 3/1939 | Mossberg et al. | 242/118.8 |
| 2,258,580 | 10/1941 | Olson | 242/118.8 |
| 2,264,029 | 11/1941 | Olson | 242/118.8 |
| 2,321,084 | 6/1943 | Howsam et al. | 242/77.3 |
| 2,521,922 | 9/1950 | Kurtz | 242/77.3 |
| 2,561,288 | 7/1951 | Panzer | 242/77.3 |
| 4,580,743 | 4/1986 | Bauer et al. | 242/118.8 |

FOREIGN PATENT DOCUMENTS 513197 11/1930 Fed. Rep. of Germany ... 242/118.8

*Primary Examiner*—Stanley N. Gilreath

*Attorney, Agent, or Firm*—Wenderoth, Lind & Ponack

[57] ABSTRACT

A reel for winding metal wire of the type having a hollow winding drum and flanges of sheet metal each having an inward cylindrical central bulge in the center thereof and extending into a respective end of the winding drum. The reel is improved by providing a reinforcing ring at each end of the winding drum and having an L-shaped cross-section with a radial section and an axial section, the ring being at the junction between the winding drum and the respective flange, the radial section being welded to an inwardly facing face of the flange by a plurality of welds at intervals spaced circumferentially around the reel, and the axial section being on the winding drum with the end of said winding drum being on bulge, or being on the bulge with the end of the winding drum on the axial section, and being welded to winding drum and bulge by a further plurality of welds at intervals spaced around the circumference of the winding drum and the bulge.

3 Claims, 2 Drawing Sheets

REEL FOR WINDING METALLIC WIRE

BACKGROUND OF THE INVENTION

This invention relates to a reel for winding metallic wire such as steel cord and steel wire.

Heretofore, a reel of this type was composed of a flange 1 and a winding drum 2 joined into one piece by a plurality of weldings W between the end of the winding drum 2 and an inward cylindrical bulge 1a provided in the central portion of the flange 1 as shown in FIG. 7.

Normally, when continuously winding a metallic wire on a reel, since a tension is applied to the metallic wire, the wound up metallic wires tend to spread toward the flanges and a side pressure is applied on the inside of the flange and the side pressure is increased as the quantity of wire wound on the reel is increased. Thus, the right and left flanges tend to be bent toward the outside and the interval between the right and left flanges is increased. Since the metallic wire is wound while detecting the inside position of the inner faces of the right and left flanges and with the traverser traversing under the control of such detection, an extended interval between the flanges causes a variation in the traverse position, leading to deteriorated winding conditions of the metallic wire, causing broken wire and entanglements.

The bent and deformed reel is reused after correcting the condition of the flanges, but can be broken during correcting or winding, and the limit of the number of corrections has been at most three.

Further, since the increase of the flange interval has been considered to be due to the bending of the flange itself, to counteract the problem the thickness of the flange has been increased to increase the rigidity. This has made the reel heavier, leading to poor workability.

As a result of the study by inventors of the cause of outward bending of the flanges, it has been found that the outer radial portion of the flange itself is not bent, but the outer radial portion of the flange as a whole is bent outward around the part 3, where the material of the central part of the flange is bent inward to form the bulged part, as a fulcrum.

The reasons the bent part forms the fulcrum of the flange bending are the following two points:

One point is that since the inward bulge 1a of the flange is formed by pressing, the thickness of the flange material at the bent part 3 is decreased by about 20–25%, leading to decreased strength of the bent part. The other point is that the flange and the winding drum are fixed by welding only at the peripheral surfaces of the joint part.

SUMMARY OF THE INVENTION

It is an object of the invention to provide a reel in which deformation and damage of the reel is prevented.

Another object of the invention is to provide an improved winding reel for metallic wire.

Still another object of the invention is to provide a reel of lighter weight.

A further object of the invention is to provide a reel having an improved joining structure between the flange and winding drum.

The reel for winding metallic wire according to the invention comprises right and left flanges and a winding drum with the inside and outside of the end of the winding drum joined to the inward bulge of the flange being joined and with a reinforcing ring having a substantially L-shaped section, and a plurality of positions between the drum and the ring and the flange and the ring at positions around the periphery of the flange and the winding drum along the ring.

Thus, the metallic wire winding reel of the above con-figuration has excellent strength and can prevent the outward bending of the flanges.

DETAILED DESCRIPTION OF THE INVENTION

Figure 1:
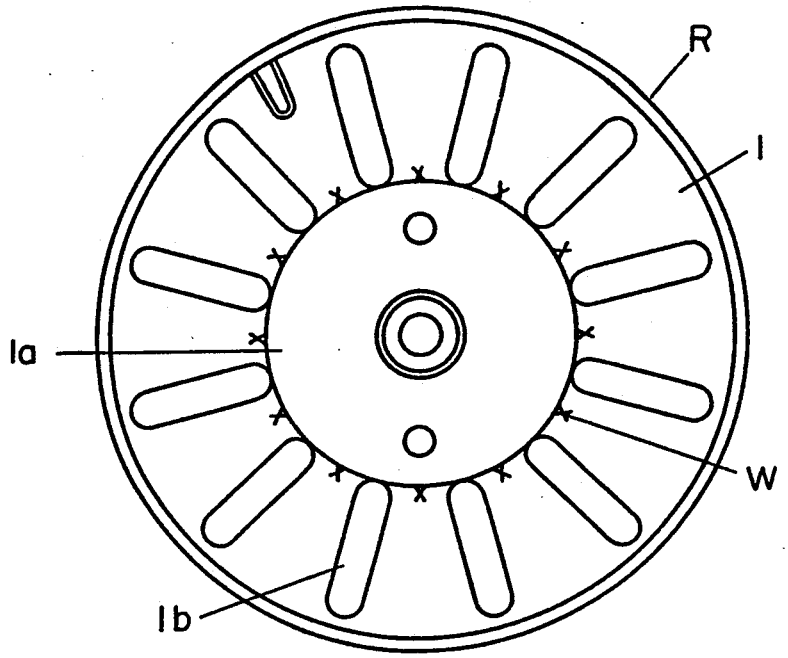
FIG. 1 is a side view of the reel.

In the drawings, R designates a steel reel for winding metallic wire comprising a winding drum 2 with an inwardly bulged cylindrical section 1a of a flange 1 extending into and joined to both of the ends of the winding drum 2. Numeral 4 designates a reinforcing ring provided at the joint portion of the inwardly bulged section **1*a* and the winding drum 2. The reinforcing ring is a steel plate formed into an L-shaped cross-sectional ring. The reinforcing ring 4 may be chamfered on either one or both the corners of a vertical or radial section 4*a* and a horizontal or axial section 4*b***.

Figure 4:
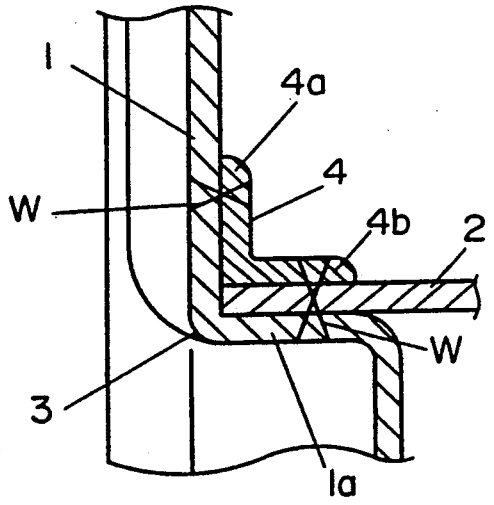
FIG. 4 is an enlarged sectional view of the essential part of FIG. 2.

The reinforcing ring 4 is fitted to the joint of the inward bulge la and winding drum 2 of the flange 1. Then, as shown in FIG. 4, the radial section **4*a* and axial section 4*b* of the reinforcing ring are both secured by spot welding at a plurality of positions in the peripheral direction so as to join each of the radial section 4*a* of the reinforcing ring 4 and the flange 1, and the axial section 4*b*, the winding drum 2**, and the inward bulge la to form a reel for winding metallic wire.

Figure 2:
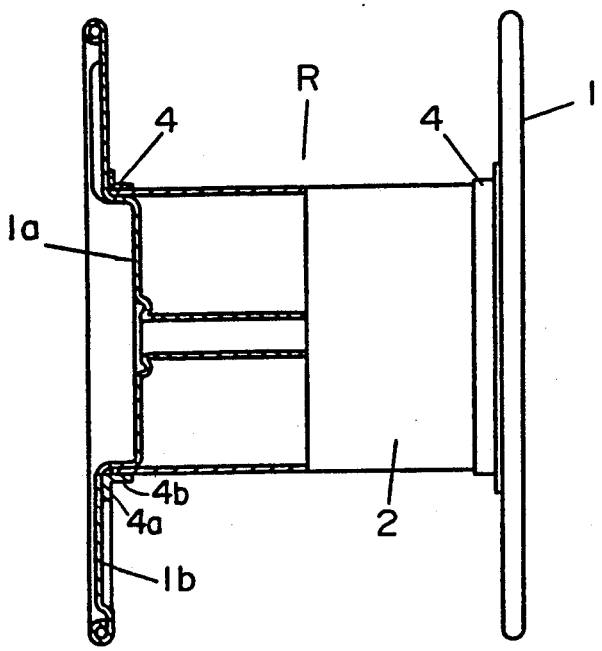
FIG. 2 is a front view showing the essential part of a first embodiment of the reel in section.
Figure 3:
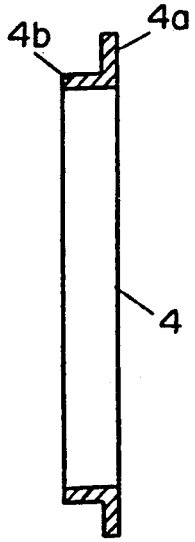
FIG. 3 is a sectional view of the reinforcing ring.
Figure 5:
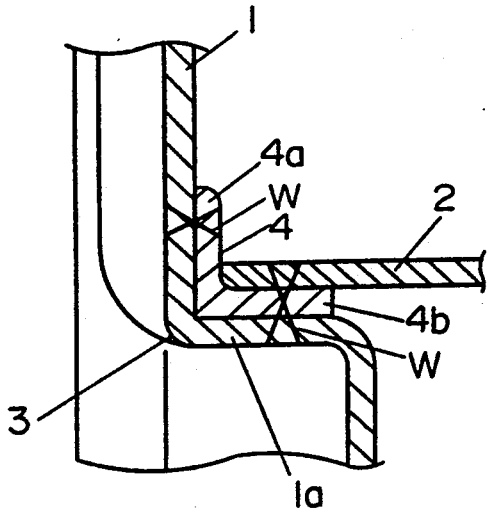
FIG. 5 is an enlarged sectional view of the essential part of another embodiment of the invention.

FIG. 5, showing another embodiment, has the horizontal section **4*b* of the reinforcing ring fitted directly on the inward bulge 1*a* of the flange 1, and the end of the winding drum 2 is fitted over the axial section 4*b* of the reinforcing ring 4, and welds are made in the same manner as in the embodiment of FIGS. 1–4 to form a reel for metallic wire winding. As shown in FIG. 2, the radial section 4*a* of the reinforcing ring 4 has an uneven configuration in the circumferential direction causing it to be engaged in close contact with the flange 1 having hollow radial reinforcing ribs 1*b*** protruding axially of the flange.

Figure 7:
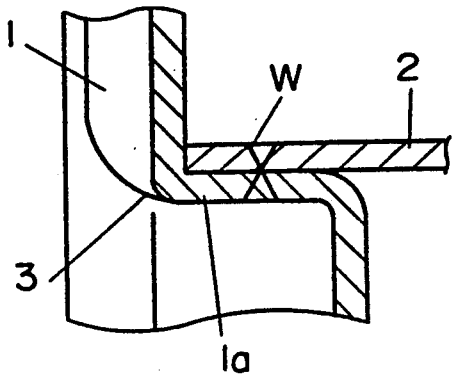
Fig. 7 (PRIOR ART)
FIG. 7 is an enlarged sectional view showing the essential part of a conventional reel.

Measuring the bending of the flange due to the winding of metal wire using the embodiments described above, and a conventional reel as shown in FIG. 7 for winding metal wire gave the results shown in the following Table.

All the reels used in this test were 20″ reels (flange diameter: 255 mm, inside diameter of the winding drum: 113 mm, winding drum width: 152 mm) and the plate thickness was one of three sizes: 1.0 mm, 1.2 mm, and 1.4 mm.

Figure 6:
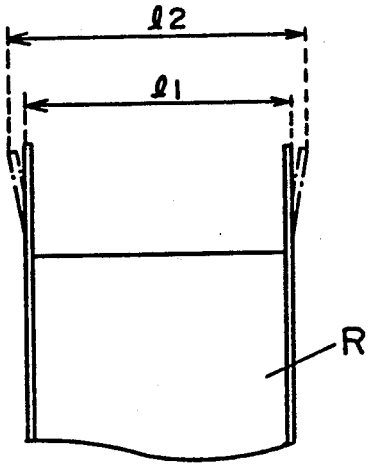
FIG. 6 is a schematic view showing the bending of the flange.

In the test, the spread l of the flange of each test reel was, as shown in FIG. 6, the difference between the outermost axial dimension $l_1$ at the outer periphery of the flanges at the end of winding.

The metal wire used in this test was steel cord of 1×5×0.25, the winding tension was 850 g, and the winding was ended when about 12,000 m were wound.

TABLE

| | | Reel No. | Plate thickness (mm) | $l_1$ (mm) | $l_2$ (mm) | l (mm) |
|---|---|---|---|---|---|---|
| Product according to the invention | FIG. 4 | 1 | 1.0 | 152.0 | 158.2 | 6.2 |
| | | 2 | 1.2 | 151.8 | 156.8 | 5.0 |
| | | 3 | 1.4 | 152.1 | 156.4 | 4.3 |
| | FIG. 5 | 4 | 1.0 | 152.2 | 158.3 | 6.1 |
| | | 5 | 1.2 | 152.0 | 157.2 | 5.2 |
| | | 5 | 1.4 | 151.9 | 156.1 | 4.2 |
| Existing product (FIG. 7) | | 7 | 1.0 | 152.2 | 163.6 | 11.4 |
| | | 8 | 1.2 | 152.0 | 160.3 | 8.3 |
| | | 9 | 1.4 | 151.8 | 159.0 | 7.2 |

As is obvious from the above Table, the reel according to the invention has a greatly decreased spread of the flanges due to the winding of metal wire in comparison with the existing reel and this trend is substantial as the plate thickness of the reel is decreased.

The reuse test of the reels according to the invention and the existing reels gave results according to which while the existing reels 7–9 were broken after 2–3 corrections, according to the invention 1–6 could be used without damage even after six corrections.

Thus, since the invention having the above configuration provides a bent section of good strength as a fulcrum, and the joint part between the inward bulge and the winding drum has a strength which provides good resistance to the side pressure exerted on the inside of the flange, the spread of the flange can be greatly reduced, leading to good winding conditions for metal wire winding. Also, since the spread, if any, is slight, the reel can be reused with small corrections, and six or more corrections are possible and extension of the reel life to two or more times that of conventional reels is possible.

Further, the reel can be made lighter by making the plate thinner and handling can be made easier for improved working efficiency.

We claim:

1. In a reel for winding metal wire of the type having a hollow winding drum and flanges of sheet metal each having an inward cylindrical central bulge in the center thereof and extending into a respective end of said winding drum, the improvement comprising:

a reinforcing ring at each end of said winding drum and having an L-shaped cross-section with a radial section and an axial section, said ring being at the junction between said winding drum and the respective flange, the radial section being welded to an inwardly facing face of the flange by a plurality of welds at intervals spaced circumferentially around said reel, and said axial section being on said winding drum with the end of said winding drum being on said bulge, and being welded to said winding drum and said bulge by a further plurality of welds at intervals space around the circumference of said winding drum and said bulge.

2. In a reel for winding metal wire of the type having a hollow winding drum and flanges of sheet metal each having an inward cylindrical central bulge in the center thereof and extending into a respective end of said winding drum, the improvement comprising:

a reinforcing ring at each end of said winding drum and having an L-shaped cross-section with a redial section and an axial section, said ring being at the junction between said winding drum and the respective flange, the radial section being welded to an inwardly facing face of the flange by a plurality of welds at intervals spaced circumferentially around said reel, and said axial section being on said bulge with the end of said winding drum being on said axial section, and being welded to said winding drum and said bulge by a further plurality of welds at intervals space around the circumference of said winding drum and said bulge.

3. The improvement as claimed in claim 1 or 2 in which the flanges have reinforcing ribs therein protruding from the flange axially of the reel, and said radial sections of said rings having a shape in the circumferential direction for causing said radial sections to be engaged in close contact with said flanges.

* * * * *